US006302267B1

(12) United States Patent
Monahan

(10) Patent No.: US 6,302,267 B1
(45) Date of Patent: Oct. 16, 2001

(54) PALETTE SYSTEM

(76) Inventor: William P. Monahan, 5809 W. Del Lago Cir., Glendale, AZ (US) 85308

( * ) Notice: Subject to any disclaimer, the term of this patent is extended or adjusted under 35 U.S.C. 154(b) by 0 days.

(21) Appl. No.: 09/454,570

(22) Filed: Dec. 7, 1999

Related U.S. Application Data

(63) Continuation-in-part of application No. 09/165,908, filed on Oct. 2, 1998, now abandoned.

(51) Int. Cl.[7] ..... B05C 17/00
(52) U.S. Cl. ..... 206/1.7; 206/1.8
(58) Field of Search ..... 206/1.7, 1.8, 1.9, 206/204, 213.1, 205, 557; 220/319.1, 318, 380

(56) References Cited

U.S. PATENT DOCUMENTS 2,593,138 * 4/1952 Gombarts ..... 206/1.7
2,932,906 * 4/1960 Chamberlin ..... 206/1.7
3,874,499 * 4/1975 Barnett, Jr. ..... 206/1.7
3,885,843 * 5/1975 Rubel ..... 206/1.7
4,444,306 * 4/1984 Benaquista ..... 206/1.7
4,512,493 * 4/1985 Von Holdt ..... 206/505
5,351,812 * 10/1994 Eagon ..... 206/1.7
5,693,393 * 12/1997 Harada ..... 428/40.1
5,804,279 * 9/1998 Pluth ..... 428/124

* cited by examiner

*Primary Examiner*—Shian Luong
(74) *Attorney, Agent, or Firm*—Martin L. Stoneman

(57) ABSTRACT

A palette system for use in storing and holding substances such as paint or glue, and for maintaining these substances in a usably moist condition for extended periods of time, is provided. The palette system is provided with a sealable open-top box structure for containing a moisture-retaining structure (preferably a substantially-wood-fiber flat sponge) whose cell structure provides a "wick effect" thereby maintaining the paint or glue in a moist condition. A water-permeable paper sheet, placed atop the moisture-retaining structure, is provided for supporting a plurality of paint or glue dabs. Also provided is a lid for sealing the open-top box structure.

27 Claims, 3 Drawing Sheets

PALETTE SYSTEM

CROSS-REFERENCE TO RELATED APPLICATIONS

This application is a continuation-in-part of application Ser. No. 09/165,908, filed Oct. 2, 1998, abandoned in favor of this application.

BACKGROUND OF THE INVENTION

1. Field of the Invention

This invention relates to providing a palette system for use in storing and holding substances such as paint or glue. More particularly, this invention concerns providing a palette system which maintains the paint in a workable condition longer than that provided with current palette systems.

2. Description of the Prior Art

Typically, paint palettes are used to provide a platform on which dabs of acrylic-type paints may be placed. Since acrylic-type paints are water-based emulsions, it is important to maintain the paint dabs in a moist condition during use, transport, and short term storage on the palette. To this end, prior art attempts have been made to provide paint palettes which are structured and arranged to maintain the paint dabs in a moist condition for extended periods of time. For example, U.S. Pat. No. 5,715,933 issued to applicant teaches the use of a stackable palette system consisting of a plurality of box-like palettes. Within these palettes are disposed a water-retentive layer, e.g., a sponge-like material, and, on the upper surface of the water-retentive layer, a sheet of porous material on which dabs of paint are placed. In operation, the moisture in the water-retentive layer is absorbed by the porous layer, thereby maintaining the paint dabs in a moist and useable condition.

Applicant is aware of other prior art attempts to provide paint palettes which are structured and arranged to maintain the paint dabs in a moist condition for extended periods of time. For example, U.S. Pat. Nos. 4,638,909 and 4,444,306 issued to, respectively, Ford and Benaquista teach paint palettes which use moisture reservoirs, comprising sponge-like materials, to prevent rapid drying of the paint. Although both of the above-referenced palette systems may be adequate for their respective intended uses, neither teaches a palette that provides a uniform moisture distribution to the entire palette surface when the paints are being used. For example, both teach the placement of their respective sponges at an end of the palette, thereby providing non-uniform moisture distribution to the paints when the respective lids are removed and the paints are used.

Applicant is further aware of one prior art attempt in which the moisture reservoir is arranged in such manner as to provide uniform moisture to the entire palette surface. For example, U.S. Pat. No. 3,874,499 issued to Barnett, Jr. teaches an artist's palette in which the palette's base portion comprises a rigid water absorbent material such as polyurethane or foam rubber. Although this system may also be adequate for its intended purpose, it fails to teach that its water absorbent material may comprise a wood-fiber or cellulose material exhibiting "wicking" power or the ability to draw and concentrate moisture to the absorbent material's surface adjacent the paints.

Generally, in terms of availability and cost concerns, palette systems which utilize a water-retentive layer typically use a plastic sponge material. Although these types of sponges are adequate to maintain the paint dabs in a useable condition for short periods of time, they have a tendency to dry from the top of the sponge, thereby necessitating the user to add water to the palette in order to maintain the porous paper, and hence the paint dabs, in a moist condition. In addition, paint palettes are often transported to the various locations in which the painting activity will be conducted. If the travel time is extensive, the user may even have to stop to refill the palette, which is inconvenient.

Thus, there exists a need for a palette system which maintains such substances as paint or glue in a moist and useable condition for longer periods than has been accomplished by prior art paint palettes.

OBJECTS OF THE INVENTION

The primary object of the present invention is to fulfill the above-mentioned needs by the provision of an improved palette system for maintaining paint or glue dabs in a moist condition. A further primary object of the present invention is to provide such an improved palette system which is efficient, easy to use, inexpensive and easy to maintain. Other objects of this invention will become apparent with reference to the following invention description.

SUMMARY OF THE INVENTION

According to a preferred embodiment of the present invention, this invention provides a palette system for holding useable substances such as paint dabs, glue dabs, or the like, comprising, in combination: a substantially-flat wetting means, having a top surface and a bottom surface, for providing a moisture supply; atop and adjacent such top surface of such wetting means, a moisture-permeable holding means for holding such useable substance; and a chamber means for containing such wetting means, such chamber means having an interior space, such interior space having a lower surface adjacent and below such bottom surface of such wetting means; such wetting means comprising a substantially-sponge-like material whose cell structure provides a "wick effect"; whereby, when such holding means and such wetting means are both moist, and when moisture evaporates from such holding means, such holding means thereby drawing off top moisture from such top surface of such wetting means, replacement moisture from within such wetting means "wicks up" to replace such top moisture, whereby such wetting means dries from the bottom up.

Additionally, it provides for such a palette system further comprising a useable substance, atop such moisture-permeable holding means, selected from the group consisting of paint and a glue-type material; and, wherein such useable substance comprises paint; and, further, wherein such useable substance comprises a glue-type material. Also, it provides such a palette system wherein such wetting means has a dry thickness from about 1/16-inch to about 1/8-inch. And, it also provides for such a palette system wherein such wetting means has a dry thickness of 1/16-inch. This invention also provides fir such a palette system wherein such wetting means has a water-saturated thickness of about 1/4-inch; and, wherein such wetting means has a water saturated thickness of about 1/4-inch. Further, it provides for such a palette system wherein such wetting means comprises a substantially-wood-fiber material.

Even further, in accordance with a preferred embodiment thereof, this invention provides for a palette system for holding paint dabs, comprising, in combination: a wetting means, comprising a porous substantially-wood-fiber material, for providing a moisture supply; atop and adjacent such wetting means, a moisture-permeable holding means for holding such paint dabs; a chamber means for containing such wetting means, such chamber means having an interior space, such interior space having a bottom surface for supporting such wetting means. And, it provides for such a palette system wherein such chamber means comprises an open-top box structure, such open-top box structure comprising a plurality of planar wall portions, each such planar wall portion having a top wall end. Also, it provides for such a palette system further comprising a sealing means for sealing such chamber means, such sealing means being structured and arranged for attachment to each of such top wall end of such planar wall portions.

Yet further still, this invention provides for such a palette system wherein such moisture-permeable holding means comprises a sheet of paper-type material; and, wherein such wetting means is substantially flat. Also, it provides for such a palette system wherein such wetting means has a dry thickness from about 1/16-inch to about 1/8-inch; and, even further, wherein such wetting means has a dry thickness of 1/16-inch. Additionally, this invention provides for such a palette system wherein such wetting means has a water-saturated thickness of about 1/4-inch; and, even further still, wherein such wetting means has a water-saturated thickness of about 1/4-inch.

In addition, in accordance with a preferred embodiment thereof, this invention provides for a method of providing a palette system, comprising, in combination, the steps of: providing an open-top box structure having a plurality of planar wall portions, each such planar wall portion having a top wall end; providing for placement within such open-top box structure a porous substantially-wood-fiber moisture-retaining structure; providing for placement atop such moisture-retaining structure a moisture-permeable palette structure; and providing a sealing structure for sealing such open-top box structure. And, it provides for such a method wherein such step of providing such porous substantially-wood-fiber moisture-retaining structure is performed when such porous substantially-wood-fiber moisture retaining structure is in a dry state.

Additionally, this invention provides for such a method further comprising the subsequent steps of: wetting such porous substantially-wood-fiber moisture-retaining structure; placing such wetted porous substantially-wood-fiber moisture-retaining structure in such open-top box structure; wetting such moisture-permeable palette structure; and placing such moisture-permeable palette structure atop and adjacent such porous substantially-wood-fiber moisture-retaining structure. Also, it provides for such a method further comprising the step of placing at least one paint dab on such moisture-permeable palette structure. Furthermore, this invention provides for such a method further comprising the step of sealing such open-top box structure by attaching such sealing structure to such top wall end of each such planar wall portions. And, it provides such a method further comprising the step of placing at least one glue dab on such moisture-permeable palette structure. Also, this invention provides for such a method further comprising the step of sealing such open-top box structure by attaching such sealing structure to such top wall end of each such planar wall portions.

Yet further still, in accordance with a preferred embodiment thereof, this invention provides for a method of making models comprising, comprising, in combination, the steps of: providing an open-top box structure having a plurality of planar wall portions, each such planar wall portion having a top wall end; providing for placement within such open-top box structure a porous substantially-wood-fiber moisture-retaining structure having a top surface; providing for placement atop such moisture-retaining structure a moisture-permeable palette structure; and wetting such porous substantially-wood-fiber moisture-retaining structure; placing such wetted porous substantially-wood-fiber moisture-retaining structure in such open-top box structure; wetting such moisture-permeable palette structure; placing such moisture-permeable palette structure atop and adjacent such porous substantially-wood-fiber moisture-retaining structure; placing at least one dab of glue-type material atop such moisture-permeable palette structure; and removing a portion of such dab of such glue with an applicator; wherein such porous substantially-wood-fiber moisture-retaining structure comprises a substantially-sponge-like material whose cell structure provides a "wick effect"; whereby, when such moisture-permeable palette structure and such porous substantially-wood-fiber moisture-retaining structure are both moist, and when moisture evaporates from such moisture-permeable palette structure, such moisture-permeable palette structure thereby drawing off top moisture from such top surface of such porous substantially-wood-fiber moisture-retaining structure, replacement moisture from within such porous substantially-wood-fiber moisture-retaining structure "wicks up" to replace such top moisture, whereby such porous substantially-wood-fiber moisture-retaining structure dries from the bottom up.

Yet additionally, this invention provides for such a method further comprising the subsequent step of using such applicator to apply such glue to the model to be glued. Also, it provides for such a method further comprising the subsequent step of providing a sealing structure for sealing such open-top box structure when such dabs of such glue are not being used.

DETAILED DESCRIPTION OF A PREFERRED EMBODIMENT AND THE BEST MODE OF PRACTICE

Figure 1:
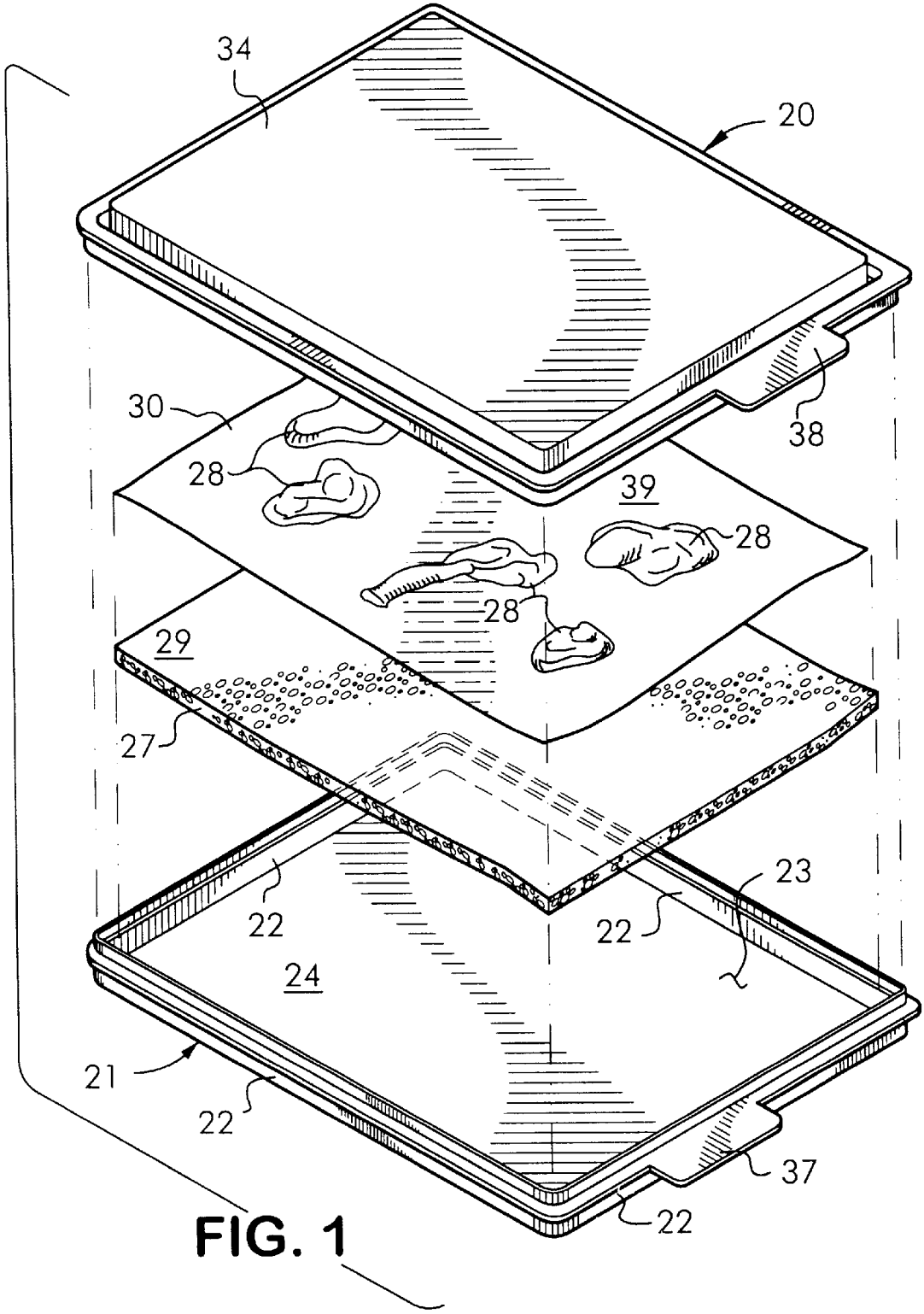
FIG. 1 is an exploded perspective view of a preferred embodiment of the palette system of the present invention, including an illustration of the wetting means embodiment of this invention.

In FIG. 1 is shown a perspective view of the preferred palette system 20 of the present invention. As shown, the palette system 20 comprises an open-top box structure or container 21 having a plurality of planar wall portions 22 defining an interior portion 23 therein. Disposed upon the inner bottom surface 24 of container 21 is the wetting element 27 of the present invention. Wetting element 27 is structured to be used in conjunction with paint palettes which utilize a sponge-type medium, on or in which the paint dabs are placed, such as the type fully disclosed in applicant's U.S. Pat. No. 5,715,933. The wetting element 27 is preferably made of a porous, substantially-flat substantially-wood-fiber material commercially available from the 3M Company, Tonawanda, N.Y. (product code 2419-4) which preferably comprises about 33% regenerated cellulose sponge material, about 0.1% pigment, and about 67% water.

The compositions of, and ways to enhance user-desired characteristics of, the cellulose sponge material for use in the substantially-wood-fiber material of the type herein described are well-known to those skilled in such art and can be found in, for example, U.S. Pat. Nos. 5,910,275 and 3,997,647 and the various patents referenced therein (which teachings are herein incorporated by reference). In addition, the construction of cellulose sponges of the type described herein is also well-known to those skilled in such art and may consist of any conventional process for producing cellulose-type sponges such as, for example, the viscose process or the process of producing such sponges from cellulose esters. Such conventional processes are well-known and are further described in the abovementioned referenced patents and will not be further described in detail herein. The wetting element 27 embodies herein a wetting means, comprising a porous substantially-wood-fiber material, for providing a moisture supply.

As will be more fully disclosed herein, it has been found that the use of a wood-fiber wetting element 27 with a container 21 (embodying herein a chamber means for containing such wetting means, such chamber means having an interior space, such interior space having a bottom surface for supporting such wetting means) of the type described herein have succeeded in maintaining the paint dabs 28 in a moist and useable condition for a substantially greater period of time than that obtained by the use of conventional plastic-type sponge materials. The use of a wood-fiber wetting element 27 is particularly advantageous when used with palette systems in which the paint dabs 28 are located adjacent the wetting element upper surface 29. It has been found that moisture within the wood-fiber wetting element 27 of this invention tends to move, or "wick", towards the wetting element upper surface 29. This is believed to be caused by most of the evaporation from the wetting element 27 being in the area of this upper surface 29.

As will be appreciated by those skilled in such art, this tendency for moisture to "wick" towards the wetting element upper surface 29 results in a maximum utilization of the wetting element 27 moisture, thereby maintaining the paint dabs 28 in a useable condition for longer periods of time. This arrangement is embodied by a wetting means comprising a substantially-sponge-like material whose cell structure provides a "wick effect", whereby, when such holding means and such wetting means are both moist, and when moisture evaporates from such holding means, such holding means thereby drawing off top moisture from such top surface of such wetting means, replacement moisture from within such wetting means "wicks up" to replace such top moisture, whereby such wetting means dries from the bottom up.

To provide an appropriate moist surface on which to place paint dabs 28, a moisture-permeable palette structure or paper sheet 30 is placed upon the wetting element upper surface 29. This arrangement allows moisture from the wetting element 27 to be absorbed by the paper sheet 30 thereby maintaining the paint dabs 28 in a usably moist condition. The paper sheet 30 embodies herein a moisture-permeable holding means for holding such paint dabs. In order to most effectively be used with acrylic paints, the paper sheet 30 is preferably of a type which is water-permeable and has sufficient wet strength to prevent rapid disintegration in use. To prevent moisture loss from the container 21 and wetting element 27 when the palette system is not in use, the present invention provides for a lid 34 which is structured and arranged to attach to the top ends 36 of each of the planar wall portions 22. The construction of lid 34 and corresponding attachment methods are as described fully in applicant's U.S. Pat. No. 5,715,933 and will not be elaborated upon in any greater detail herein. The lid 34 embodies herein a sealing means for sealing such chamber means, such sealing means being structured and arranged for attachment to each of such top wall end of such planar wall portions. Lid 34 further provides the benefit of allowing the palette system 20 to be safely transported with the paint dabs 28 stored therein without risk of contaminating the paint by accidental contact with the users clothing or other outside contaminants. Tabs 37 and 38 may be provided on, respectively, the container 21 and lid 34 to facilitate removal of the lid 34.

Figure 2:
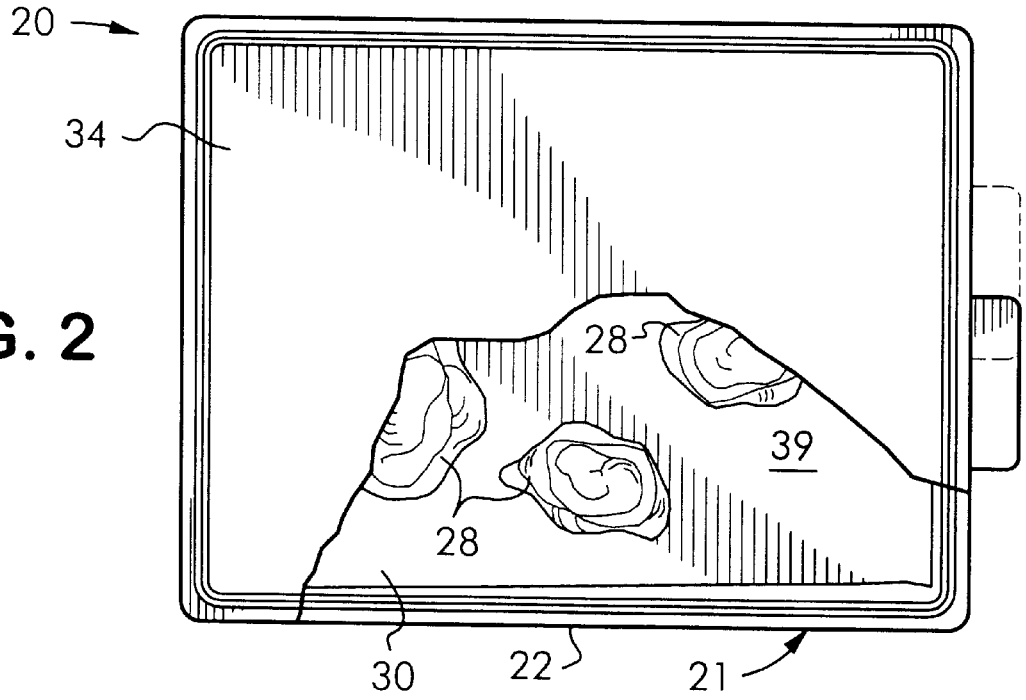
FIG. 2 is a top plan-view, partially cut-away, of a preferred embodiment of the palette system with the lid installed.

Shown in FIG. 2, in partial cut-away, is a top view of the preferred embodiment of the palette system 20 of the present invention. Shown is the box-like container 21 having a plurality of planar wall portions 22. Disposed within container 21 is the paper sheet 30 arranged for placement on the wetting element upper surface 29 (not shown in FIG. 2). Also shown are a plurality of paint dabs 28 arranged on the paper sheet upper surface 39. The lid 34 is preferably made of a semi-flexible plastic (in well-known ways) for easier attachment and removal. In order to most efficiently maximize the number and size of the paint dabs 28 stored within the container 21, it is preferred that and the paper sheet 30 have a surface area approximately equal to the surface area of the interior portion 23, as shown.

Figure 3:
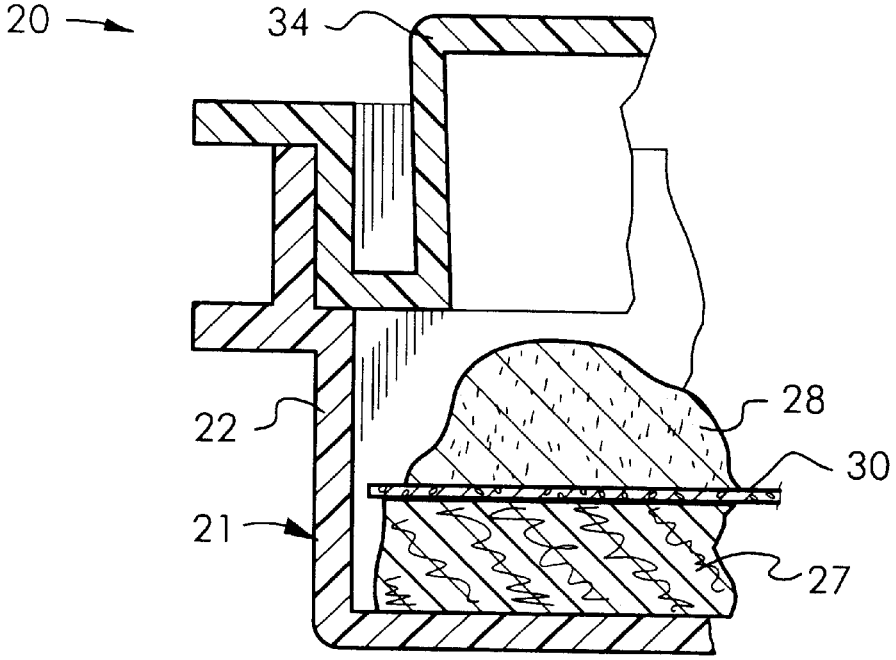
FIG. 3 is a partial cross-sectional view, in elevation, illustrating the arrangement of the various component parts comprising the palette system.

FIG. 3 is a cross-sectional view, in elevation, of the palette system 20 of the present invention illustrating the arrangement of the various herein described components. For use with the container 21 herein illustrated and described, the preferred wood-fiber wetting element 27 has a preferred "dry" thickness range of about 1/16-inch to about 1/8-inch. The dry thickness is defined herein as the measured thickness when the wetting element 27 is in a dry state. Upon saturation, the preferred wetting element 27 expands to a "wet" thickness of approximately 1/4 inch. The wet thickness is defined herein as the measured thickness when the wetting element 27 is in a water-saturated state. Although other dry thicknesses may be used, it is recommended that the dry thickness be chosen so as to maintain an adequate clearance height between a useable paint dab 28 and the means used to seal the container 21, e.g., lid 34, when the wetting element 27 is in a water-saturated state.

Placed on the wetting element upper surface 29 is a paper sheet 30, the upper surface 39 of which holds a plurality of paint dabs 28. For the type of palette system 20 disclosed herein, it is recommended that paper sheet 30 be immersed in water for approximately 30–45 minutes prior to use. In addition, wetting element 27 is to be water-saturated prior to placement within container 21. It is recommended that the wood-fiber wetting element 27 be sized accordingly to fit the applicable container 21 size. For the wood-fiber wetting element 27 disclosed herein, sizing should take into account expansion of the sponge material when saturated with a liquid. It has been found that a wetting element 27 with preferred dry dimensions of 6 3/8 in.×7 7/8 in. expands to wet dimensions of 7 in.×8 1/2 in. when saturated. It has further been found that the resulting wet dimensions of wetting element 27 substantially fills the interior portion 23 of the preferred container 21 described herein.

Accordingly, as illustrated in the drawings, the preferred method of practicing the present invention is embodied by the steps of: providing an open-top box structure having a plurality of a plurality of planar wall portions, each such planar wall portion having a top wall end; providing for placement within such open-top box structure a porous substantially-wood-fiber moisture-retaining structure; providing for placement atop such moisture-retaining structure a moisture-permeable palette structure; providing a sealing structure for sealing such open-top box structure; and, wherein such step of providing such porous substantially-wood-fiber moisture-retaining structure is performed when such porous substantially-wood-fiber moisture retaining structure is in a dry state.

In addition, the preferred method consists of the additional steps of: wetting such porous substantially-wood-fiber moisture-retaining structure; placing such wetted porous substantially-wood-fiber moisture-retaining structure in such open-top box structure; wetting such moisture-permeable palette structure; placing such moisture-permeable palette structure atop and adjacent such porous substantially-wood-fiber moisture-retaining structure; placing at least one paint dab on such moisture-permeable palette structure; and sealing such open-top box structure by attaching such sealing structure to such top wall end of each such planar wall portions.

Comparative Test Results

Trial 1

To determine the relative drying times between the wood-fiber sponge and a conventional plastic-fiber sponge, ⅓ cup of water was placed into two properly sized palette holders. Into palette holder 1 was placed a wetting element comprising a wood-fiber sponge of the type previously described. Into palette holder 2 was placed a conventional plastic sponge-type wetting element having the same surface area as the wood-fiber wetting element. Both wetting elements were moistened prior to insertion into their respective palette holders. Similarly placed over each wetting element was placed a moistened paper sheet of the type illustrated and described previously with respect to FIGS. 1–3. Time trials were then conducted to determine the elapsed time from time zero (each wetting element inserted into a respective palette holder) to when no perceivable moisture (as determined from manual touching) remained in the two wetting elements. The relevant data and conclusions are tabulated as follows:

Trial 1

| | Thickness (inches) | Elapsed time (Hours) |
|---|---|---|
| Wood-fiber | 1/16 | 44 |
| Plastic-fiber | 1/16 | 2 |

As shown in the tabulated results, the wood-fiber sponge maintained a sufficient amount of moisture so as be able to maintain a paint dab in a moist and useable condition for a period of approximately 22 times longer than the plastic-fiber sponge. Mainly accounting for these results was the fact that the wood-fiber sponge exhibited a "wick effect" in that the top surface of the sponge dried at a slower rate than the sponge bottom surface. In comparison, the plastic-fiber sponge dried from the top down. Particularly for those palette systems in which the paint dabs are placed adjacent the top surface of the wetting element, this is an important distinction. The wood-fiber sponge effectively "pumps" the remaining moisture in the sponge to the sponge's top surface (in the direction in which the major evaporation surfaces are removing water), thereby maximizing the use of the sponge's moisture to maintain the paint dabs in a moist condition for a maximum amount of time.

Trial 2

A second comparative test was conducted without the use of the paper sheet to determine if the paper sheet was producing a possible wick effect when used in conjunction with the wood fiber wetting element. According to this trial, ⅓ cup of water was again placed into two palette holders. Into palette holder 1 was placed a wetting element comprising a wood-fiber sponge of the type previously described and used in Trial 1. Into palette holder 2 was placed a conventional plastic sponge-type wetting element (like that used in Trial 1) having the same surface area as the wood-fiber wetting element. Both wetting elements contained no moisture prior to being placed into their respective palette holders. Initially, it was shown that the wood-fiber sponge exhibited a greater absorption capacity than the plastic sponge as evidenced by the observation that less free-standing water remained in the palette when the wood-fiber sponge was placed therein. Time trials were then conducted to determine the elapsed time from time zero (each wetting element inserted into a respective palette holder) to when no perceivable moisture (as determined from manual touching) remained in the two wetting elements. The relevant data and conclusions are tabulated as follows:

Trial 2

| | Thickness (inches) | Elapsed time (Hours) |
|---|---|---|
| Wood-fiber | 1/16 | 44 |
| Plastic-fiber | 1/16 | 4 |

At the expiration of 30 hours, a further trial was conducted to determine if any remaining moisture in the two sponges would "wick" to the sponge surface if a water-permeable material, e.g., a napkin, were placed on each of the sponge top surfaces. Upon placing a typical napkin on the surface of the wood-fiber sponge, the napkin became saturated due to the remaining water in the sponge. For the plastic sponge, no such effect was apparent even after only a four hour drying time. The results obtained from the test trials show that a more efficient palette system may be obtained by using a wetting element comprising a substantially wood-fiber material. This increase in efficiency translates into a more versatile and a lower maintenance palette system thus enabling the user to use, or be away from, the palette system for longer periods of time than previously experienced with conventional palette systems.

Figure 4:
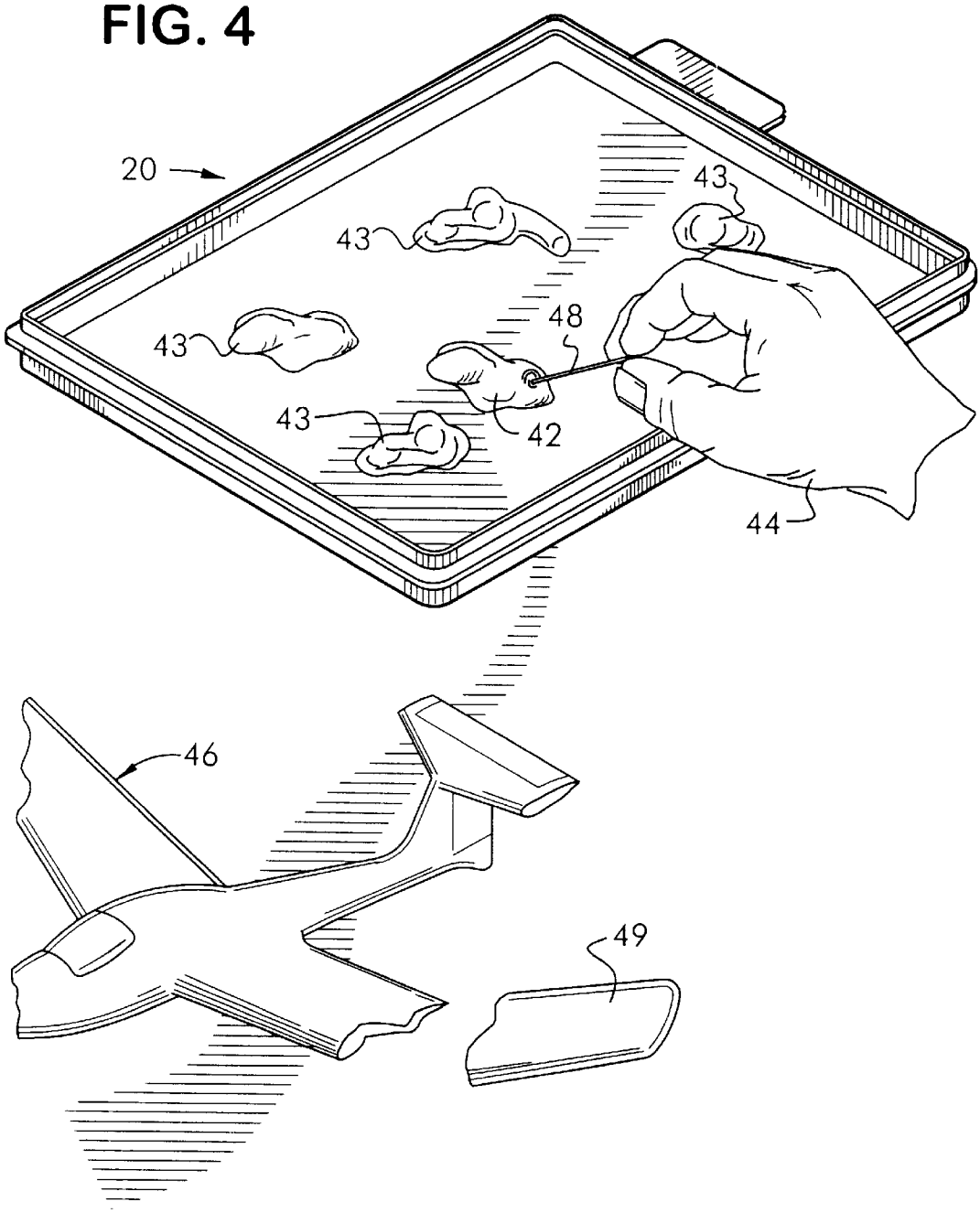
FIG. 4 is a perspective view of the preferred embodiment of the palette system showing an alternate preferred use of the palette system for holding dabs of glue.

In FIG. 4 is shown a perspective view of the preferred palette system 20 of the present invention as substantially illustrated and described previously with respect to FIGS. 1–3. Shown is the palette system 20 of this invention holding both glue dabs 42 and paint dabs 43 for use by the user 44 for purposes of, for example, constructing a model 46. As shown, the user is using an applicator 48 such as a toothpick or the like to remove a portion of the glue dab 42 for application to the model 46. As will be appreciated by those skilled in such art, especially the art of model building, applicant has discovered that the palette system 20 of the present invention also provides the useful function of preserving other useable substances such as glue dabs 42 in a workable condition for longer periods of time with the result that less glue need be consumed for a particular project. In addition, for those model building applications which often require that a part be painted prior to installation, the palette system 20 of this invention allows the paint dabs 43 to remain in a workable condition while the user 44 glues the model part 49 to the model 46. As will be apparent to those skilled in such art, the glues to be used with the palette system 20 of the present invention preferably comprise those glues or other suitable adhesives having a natural or synthesized polymer structure which do not react adversely to the presence of moisture. For exemplary purposes, such suitable glues may comprise those nonreactive synthetic glues such as White or polyvinyl acetate (PVA) type glues.

In addition, to maintain the glue and paint dabs 42 and 43 in a useable condition when not in use, the user 44 may attach the lid 34 to the top ends 36 of each of the planar wall portions 22 in the manner fully described above.

Although applicant has described applicant's preferred embodiment of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A palette system for holding and maintaining moisture in a useable substance comprising paint dabs, or glue dabs, or the like, comprising, in combination:

a) a substantially-flat wetting means, having a top surface and a bottom surface, for providing a moisture supply;

b) atop and adjacent said top surface of said wetting means, a moisture-permeable holding means for holding the useable substance; and c) a chamber means for containing said wetting means, said chamber means having an interior space, said interior space having a lower surface adjacent and below said bottom surface of said wetting means;

d) said wetting means comprising a substantially-sponge-like material whose cell structure provides a "wick effect";

e) wherein said wetting means is selected from the group consisting of materials having substantially the same properties as a wood fiber material; and f) whereby, when said holding means and said wetting means are both moist, and when moisture evaporates from said holding means, said holding means thereby drawing off top moisture from said top surface of said wetting means, replacement moisture from within said wetting means "wicks up" to replace said top moisture, whereby said wetting means dries from the bottom up.

2. The palette system according to claim 1 further comprising a useable substance, atop said moisture-permeable holding means, selected from the group consisting of paint and a glue-type material.

3. The palette system according to claim 2 wherein said useable substance comprises paint.

4. The palette system according to claim 2 wherein said useable substance comprises a glue-type material.

5. The palette system according to claim 1 wherein said wetting means has a dry thickness from about 1/16-inch to about 1/8-inch.

6. The palette system according to claim 5 wherein said wetting means has a dry thickness of 1/16-inch.

7. The palette system according to claim 6 wherein said wetting means has a water-saturated thickness of about 1/4-inch.

8. The palette system according to claim 1 wherein said wetting means has a water-saturated thickness of about 1/4-inch.

9. A palette system for holding paint dabs, comprising, in combination:

(a) a wetting means, having a top surface and comprising a porous substantially-wood-fiber material, for providing a moisture supply;

(b) atop and adjacent said wetting means, a moisture-permeable holding means for holding said paint dabs; and (c) a chamber means for containing said wetting means, said chamber means having an interior space, said interior space having a bottom surface for supporting said wetting means;

(d) wherein said holding means comprises a substantially-flat pallet means for holding said paint dabs; and (e) whereby, when said holding means and said wetting means are both moist, and when moisture evaporates from said holding means, said holding means thereby drawing off top moisture from said top surface of said wetting means, replacement moisture from within said wetting means "wicks up" to replace said top moisture, whereby said wetting means dries from the bottom up.

10. The palette system according to claim 9 wherein said chamber means comprises an open-top box structure, said open-top box structure comprising a plurality of planar wall portions, each said planar wall portion having a top wall end.

11. The palette system according to claim 10, further comprising a sealing means for sealing said chamber means, said sealing means being structured and arranged for attachment to each of said top wall end of said planar wall portions.

12. The palette system according to claim 9 wherein said moisture-permeable holding means comprises a sheet of paper-type material.

13. The palette system according to claim 9 wherein said wetting means is substantially flat.

14. The palette system according to claim 13 wherein said wetting means has a dry thickness from about 1/16-inch to about 1/8-inch.

15. The palette system according to claim 14 wherein said wetting means has a dry thickness of 1/16-inch.

16. The palette system according to claim 15 wherein said wetting means has a water-saturated thickness of about 1/4-inch.

17. The palette system according to claim 13 wherein said wetting means has a water-saturated thickness of about 1/4-inch.

18. A method of providing a palette system, comprising, in combination, the steps of:

(a) providing an open-top box structure having a plurality of planar wall portions, each said planar wall portion having a top wall end;

(b) providing for placement within said open-top box structure a porous substantially-wood-fiber moisture-retaining structure having a top surface;

(c) providing for placement atop said moisture-retaining structure a moisture-permeable palette structure; and (d) providing a sealing structure for sealing said open-top box structure;

(e) whereby, when said palette structure and said moisture-retaining structure are both moist, and when moisture evaporates from said palette structure, said palette structure thereby drawing off top moisture from said top surface of said moisture-retaining structure, replacement moisture from within said moisture-retaining structure "wicks up" to replace said top moisture, whereby said moisture-retaining structure dries from the bottom up.

19. The method according to claim 18 wherein said step of providing said porous substantially-wood-fiber moisture-retaining structure is performed when said porous substantially-wood-fiber moisture retaining structure is in a dry state.

20. The method according to claim 18 further comprising the subsequent steps of:

(a) wetting said porous substantially-wood-fiber moisture-retaining structure;

(b) placing said wetted porous substantially-wood-fiber moisture-retaining structure in said open-top box structure;

(c) wetting said moisture-permeable palette structure; and (d) placing said moisture-permeable palette structure atop and adjacent said porous substantially-wood-fiber moisture-retaining structure.

21. The method according to claim 20 further comprising the step of placing at least one paint dab on said moisture-permeable palette structure.

22. The method according to claim 21 further comprising the step of sealing said open-top box structure by attaching said sealing structure to said top wall end of each said planar wall portions.

23. The method according to claim 20 further comprising the step of placing at least one glue dab on said moisture-permeable palette structure.

24. The method according to claim 23 further comprising the step of sealing said open-top box structure by attaching said sealing structure to said top wall end of each said planar wall portions.

25. A method of making models comprising, comprising, in combination, the steps of:

(a) providing an open-top box structure having a plurality of planar wall portions, each said planar wall portion having a top wall end;

(b) providing for placement within said open-top box structure a porous substantially-wood-fiber moisture-retaining structure having a top surface;

(c) providing for placement atop said moisture-retaining structure a moisture-permeable palette structure; and (d) wetting said porous substantially-wood-fiber moisture-retaining structure;

(e) placing said wetted porous substantially-wood-fiber moisture-retaining structure in said open-top box structure;

(f) wetting said moisture-permeable palette structure;

(g) placing said moisture-permeable palette structure atop and adjacent said porous substantially-wood-fiber moisture-retaining structure;

(h) placing at least one dab of glue-type material atop said moisture-permeable palette structure; and (i) removing a portion of said dab of said glue with an applicator;

(j) wherein said porous substantially-wood-fiber moisture-retaining structure comprises a substantially-sponge-like material whose cell structure provides a "wick effect";

(k) whereby, when said moisture-permeable palette structure and said porous substantially-wood-fiber moisture-retaining structure are both moist, and when moisture evaporates from said moisture-permeable palette structure, said moisture-permeable palette structure thereby drawing off top moisture from said top surface of said porous substantially-wood-fiber moisture-retaining structure, replacement moisture from within said porous substantially-wood-fiber moisture-retaining structure "wicks up" to replace said top moisture, whereby said porous substantially-wood-fiber moisture-retaining structure dries from the bottom up.

26. The method according to claim 25 further comprising the subsequent step of using said applicator to apply said glue to the model to be glued.

27. The method according to claim 26 further comprising the subsequent step of providing a sealing structure for sealing said open-top box structure when said dabs of said glue are not being used.

* * * * *